US007988317B2

(12) United States Patent
Kang

(10) Patent No.: US 7,988,317 B2
(45) Date of Patent: Aug. 2, 2011

(54) STORAGE CASE

(76) Inventor: Chang Hwan Kang, Gyeonggi-do (KR)

( * ) Notice: Subject to any disclaimer, the term of this patent is extended or adjusted under 35 U.S.C. 154(b) by 317 days.

(21) Appl. No.: 12/441,814

(22) PCT Filed: Sep. 28, 2007

(86) PCT No.: PCT/KR2007/004746

§ 371 (c)(1),
(2), (4) Date: Mar. 18, 2009

(87) PCT Pub. No.: WO2008/039018

PCT Pub. Date: Apr. 3, 2008

(65) Prior Publication Data

US 2010/0008074 A1 Jan. 14, 2010

(30) Foreign Application Priority Data

Sep. 29, 2006 (KR) ..... 20-2006-0026806 U

(51) Int. Cl.
*F21V 33/00* (2006.01)

(52) U.S. Cl. ..... 362/155; 362/154

(58) Field of Classification Search ..... 362/154, 362/155
See application file for complete search history.

(56) References Cited

U.S. PATENT DOCUMENTS 5,743,038 A 4/1998 Soto
2010/0213392 A1* 8/2010 Hatzav et al. ..... 362/154

FOREIGN PATENT DOCUMENTS

JP 3094455 U 3/2003
KR 20-0226848 Y1 6/2001
KR 20-0249107 Y1 10/2001

OTHER PUBLICATIONS

International Search Report: dated Feb. 4, 2008; PCT/KR2007/004746.

* cited by examiner

*Primary Examiner* — David V Bruce
(74) *Attorney, Agent, or Firm* — Ladas & Parry LLP

(57) ABSTRACT

Provided is a storage case which can be opened and closed by a main body and a cover, including: an electric power switch having function of an electric contact switch added to a locking unit between the body and the cover; a lamp which emits light and flickers by electric power supplied according to an on- or off-state of the electric power switch; a half mirror which operates as a mirror or a glass plate through change of light transmissivity; a general mirror located at the back of the storage case for reflectivity of light; and a light transfer medium positioned within a gap space between the half mirror and the general mirror, and controls a refractive index of light, to reveal a feeling of solidity. Through self-lighting in the storage case, values of jewels, cosmetics etc., contained in the storage case as well as the storage case can be heightened.

5 Claims, 2 Drawing Sheets

STORAGE CASE

TECHNICAL FIELD

The present invention relates to a storage case, and more particularly, to a storage case which uses a half mirror, a general mirror, and a flickering lamp, and is used as a mirror and as a lighting according to a light emission operation of the flickering lamp, to thereby derive user's interest.

BACKGROUND ART

In general, storage cases are used to collect and keep safely precious or important goods at a place to prevent loss or robbery. The storage cases are made of metal as a man material. The storage cases which are molded in the form of a box shape so as to open and close and then a locker unit is provided to lock and uncover the storage cases are widely used.

Referring to FIG. 1, a conventional storage case will be described below. As illustrated, the conventional storage case includes a body 10 and a cover 20 which are connected by a hinge 30 so as to open and close it.

Here, the body 10 and the cover 20 can be made of various kinds of materials but will be described with respect to the case where a metal plate such as a steel plate is molded in the form of a box using a press, as an example.

Fitting grooves are perforated on part of the side walls of the body 10 and the cover 20. A plurality of fixing pieces 42 are fitted into and fixed to the fitting grooves, respectively, so as to be protruded inwards from the body 10 and the cover 20. The plurality of fixing pieces 42 are fitted into a plurality of coupling holes (not shown) formed on hinge plates 30, respectively, in correspondence to the plurality of fixing pieces 42, and then bent so that the hinge plates 30 are firmly fixed to the body 10 and the cover 20, respectively.

The above-described conventional storage case is fabricated through a number of fabrication steps. The outlined fabrication method of making the conventional storage case includes the steps of: cutting a metal plate to be molded into the body 10 and the cover 20, press-molding the body 10 and the cover 20; perforating one of the side walls of the body 10 and the cover 20, respectively, in order to form grooves into which a plurality fixing pieces are fitted; coupling hinge plates with the plurality of fixing pieces; and finishing to complete a storage case.

Through the above-described storage case fabrication method, the body 10 and the cover 20 are combined into a structure of a storage case which can be opened and closed. Then, although it is not shown in the drawings, a buffering material having an impact absorption function, for example, a sponge material is filled in the storage case. Accordingly, articles contained in the storage case can be prevented from being damaged. In addition, various kinds of patterns are carved on the outer surface of the storage case, to thereby enhance aesthetic, that is, make the storage case look charming.

Meanwhile, jewels or precious stones can be kept in custody or displayed in gorgeous storage cases in order to enhance a value of the jewels or precious stones contained in the storage cases. Further, if special illuminations or other ornaments are used for storage cases, values of the storage cases and jewels or precious stones contained in the storage cases can be heightened. However, the above-described storage case has the difficulty in expressing a feeling of preference on jewels or precious stones contained in the storage case, other than simple visual patterns or designs.

DISCLOSURE OF THE INVENTION

In order to solve the above problems, it is an object of the present invention to provide a storage case which uses a half mirror, a general mirror, and a flickering lamp, and is used as a mirror and as a lighting according to a light emission operation of the flickering lamp, to thereby derive user's interest.

To accomplish the above object of the present invention, there is provided a storage case which can be opened and closed by a main body and a cover, the storage case comprising: an electric power switch having function of an electric contact switch which is added to a locking unit between the body and the cover; a lamp which emits light and flickers by electric power which is supplied according to an on- or off-state of the electric power switch; a half mirror which operates as a mirror or a glass plate through change of light transmissivity at the time when the lamp emits light; a general mirror located at the back of the storage case for reflectivity of light irradiated from the lamp at the time when the lamp emits light; and a light transfer medium which is positioned within a gap space between the half mirror and the general mirror, and controls a refractive index of light irradiated from the lamp, to reveal a feeling of solidity.

Preferably but not necessarily, according to an additional feature of the present invention, the electric power switch uses a general contact switch and a transistor and thus if the contact switch is turned on, the transistor keeps an off-state, while if the contact switch is turned off, the transistor keeps an on-state, and wherein the transistor is used as a path of electric power supplied to the lamp.

Preferably but not necessarily, according to an additional feature of the present invention, a light emitting diode (LED) is used as the lamp, in which the LED is a three-color LED having a self-flickering function.

Preferably but not necessarily, according to an additional feature of the present invention, the light transfer medium is air.

Preferably but not necessarily, according to an additional feature of the present invention, the light transfer medium is a solid film whose reflection plane is processed.

BEST MODE FOR CARRYING OUT THE INVENTION

Figure 1:
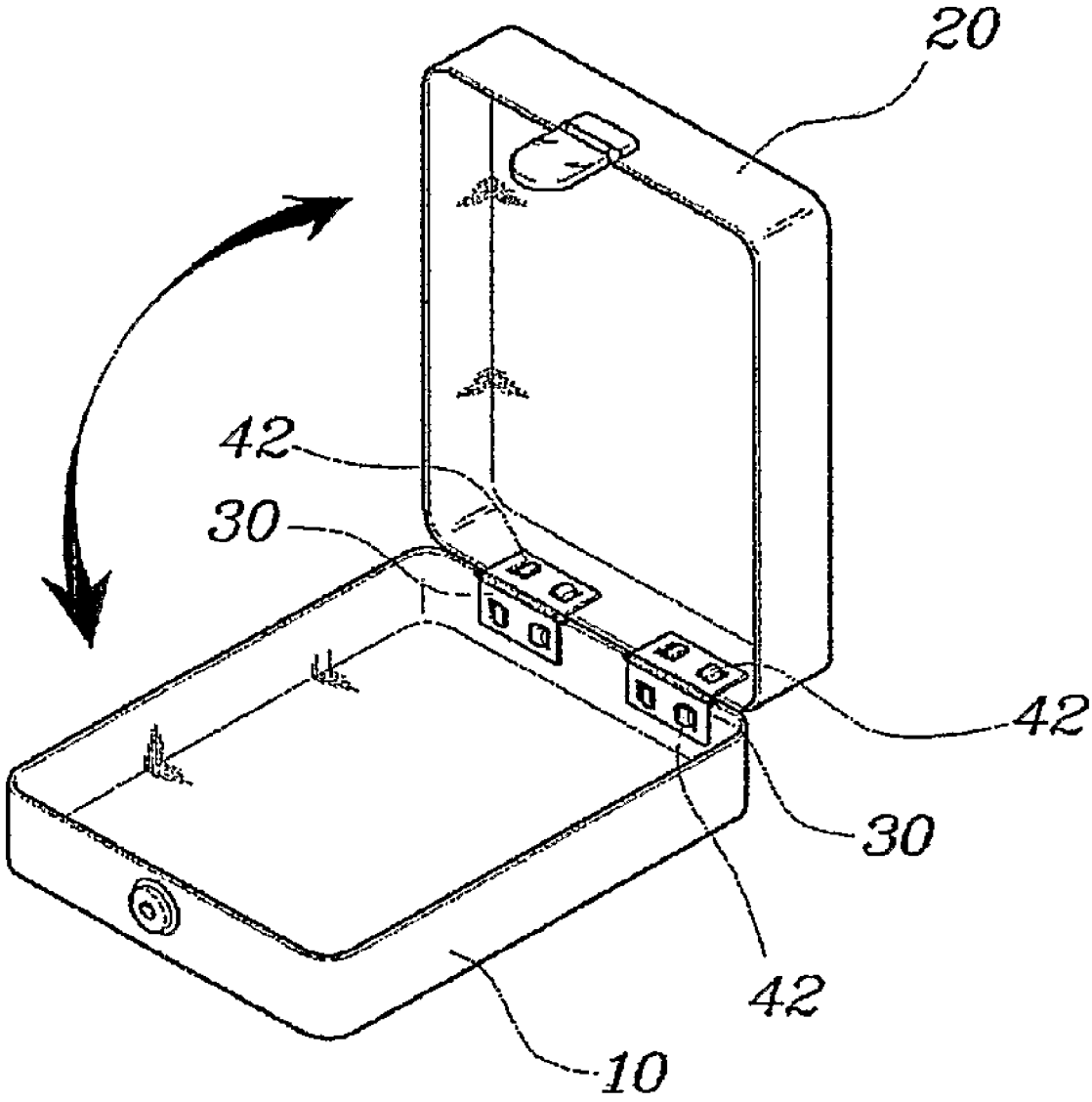
FIG. 1 is a perspective view showing a general configuration of a conventional storage case.

Hereinbelow, a storage case according to a preferred embodiment of the present invention will be described with reference to the accompanying drawings. Like reference numerals are assigned for like elements in the drawings.

Figure 2:
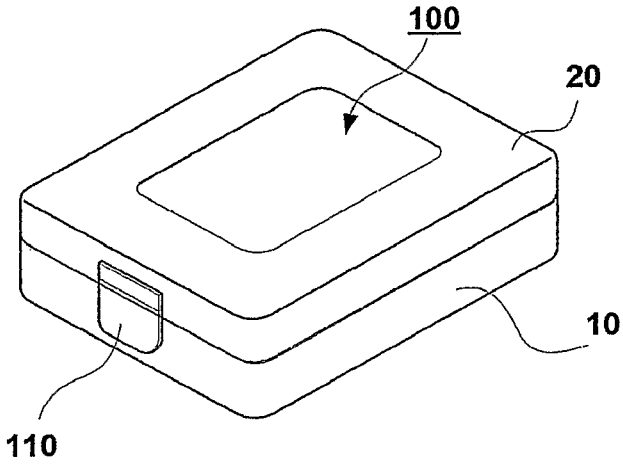
FIG. 2 is a perspective view showing an external appearance of a storage case according to the present invention.
Figure 3:
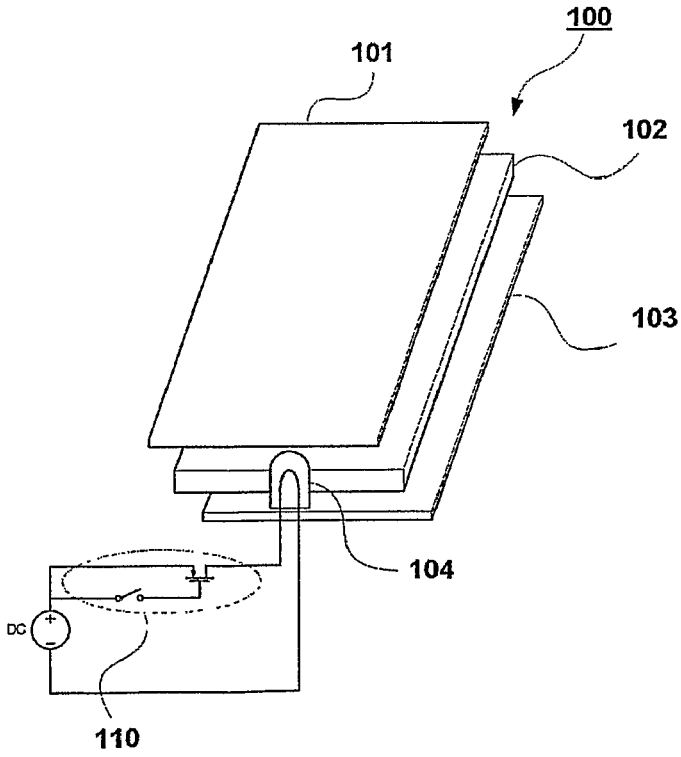
FIG. 3 shows a circuitry composition for a light emission flickering function according to the present invention.

As shown in FIGS. 2 and 3, a storage case according to the present invention does not greatly differ from a general storage case, that is, the above-described conventional storage case, in view of its external appearance.

However, the storage case according to the present invention further includes a light emission mirror portion which is denoted as a reference numeral 100, and an electric power switch which is denoted as a reference numeral 110.

The electric power switch 110 is accomplished by adding a function of an electrical contact switch to a portion which is used as a simple locking unit in the conventional storage case.

The light emission mirror portion 100 includes: a lamp 104 which emits light and flickers by electric power which is supplied according to an on- or off-state of the electric power switch 110; a half mirror 101 which operates as a mirror or a glass plate through change of light transmissivity at the time when the lamp 104 emits light; a general mirror 103 located at the back of the storage case for reflectivity of light irradiated from the lamp 104 at the time when the lamp 104 emits light; and a light transfer medium 102 which is positioned within a gap space between the half mirror 101 and the general mirror 103, and controls a refractive index of light irradiated from the lamp 104, to reveal a feeling of solidity.

In addition, the electric power switch 110 uses a general contact switch and a transistor and thus if the contact switch is turned on, the transistor keeps an off-state, to thereby prevent the lamp 104 from emitting light. That is, in the case that the storage case is in a closed position, the electric power is prevented from being supplied from the lamp 104, in order to save consumption of a battery which is used as the electric power source at maximum. Meanwhile, if the contact switch is turned off, the transistor keeps an on-state, and the transistor is used as a path of electric power supplied to the lamp 104.

However, in the case that a battery may be consumed without saving, such a transistor does not need to be installed in the storage case. In this case, the lamp 104 can be embodied to emit light if the contact switch is turned on.

In addition, it is preferable that a light emitting diode (LED) is used as the lamp 104. More preferably, the LED is a three-color LED having a self-flickering function, an illumination of the storage case, but is not limited thereto.

Further, the light transfer medium is air. In particular, it is preferable that the light transfer medium is a solid film whose reflection plane is processed.

An operation of the storage case according to the present invention will be described below, based on the FIGS. 2 and 3 composition. When the storage case is in a closed position, the contact switch of the electric power switch 110 maintains an on-state.

Therefore, voltage of a DC power battery is applied to the gate electrode of a transistor. Accordingly, no electric current flows between the drain electrode of the transistor and the source electrode thereof. As a result, power supply is cut-off toward the lamp 104.

Therefore, the half mirror 101 of the light emission mirror portion 100 which is disposed on the surface of the upper case of the storage case, is used as a general mirror. Here, if a user opens the storage case, the contact switch of the power switch 110 maintains an off-state.

Accordingly, electric power is not applied to the gate electrode of the transistor. As a result, electric current flows between the drain electrode of the transistor and the source electrode thereof. That is, electric current is conducted between the drain electrode of the transistor and the source electrode thereof. Accordingly, the lamp 104 emits light.

Thus, the light irradiated according to a light emitting operation of the lamp 104 has a reflectivity, that is, directivity, in one direction through the general mirror 103, that is, toward the half mirror 101. Further, a refractive index of light is adjusted through the light transfer medium 102 which is located between the half mirror 101 and the general mirror 103. Accordingly, the light emission mirror portion 100 functions as an illumination through a phenomenon such as scattering.

Alternatively, the half mirror may be implemented to be positioned to face to the inside of the storage case, according to necessity. However, it is apparent to one skilled in the art that such a modification does not depart off from the objective and the spirit of the present invention.

In addition, the present invention may improve the function of a general-purpose storage case for containing general articles as well as a special-purpose storage case for storing jewels.

As described above, through self-lighting in a storage case according to the present invention, values of jewels, cosmetics etc., which are contained in the storage case as well as the storage case can be heightened.

As described above, the present invention has been described with respect to particularly preferred embodiment. However, the present invention is not limited to the above embodiment, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

As described above, the present invention provides a storage case which uses a half mirror, a general mirror, and a flickering lamp, and is used as a mirror and as a lighting according to a light emission operation of the flickering lamp, to thereby derive user's interest.

What is claimed is:

1. A storage case which can be opened and closed by a main body and a cover, the storage case comprising:

an electric power switch having function of an electric contact switch which is added to a locking unit between the body and the cover;

a lamp which emits light and flickers by electric power which is supplied according to an on- or off-state of the electric power switch;

a half mirror which operates as a mirror or a glass plate through change of light transmissivity at the time when the lamp emits light;

a general mirror located at the back of the storage case for reflectivity of light irradiated from the lamp at the time when the lamp emits light; and a light transfer medium which is positioned within a gap space between the half mirror and the general mirror, and controls a refractive index of light irradiated from the lamp, to reveal a feeling of solidity.

2. The storage case according to claim 1, wherein the electric power switch uses a general contact switch and a transistor and thus if the contact switch is turned on, the transistor keeps an off-state, while if the contact switch is turned off, the transistor keeps an on-state, and wherein the transistor is used as a path of electric power supplied to the lamp.

3. The storage case according to claim 1, wherein a light emitting diode (LED) is used as the lamp, in which the LED is a three-color LED having a self-flickering function.

4. The storage case according to claim 1, wherein the light transfer medium is air.

5. The storage case according to claim 1, wherein the light transfer medium is a solid film whose reflection plane is processed.

* * * * *